US005110130A

United States Patent [19]

Aulicino

[11] Patent Number: 5,110,130

[45] Date of Patent: May 5, 1992

[54] PUZZLE HAVING TILES TRANSFERABLE BETWEEN CASEMENTS CONNECTED IN A LOOP

[76] Inventor: Daniel Aulicino, Bedford, N.Y.

[21] Appl. No.: 648,863

[22] Filed: Jan. 31, 1991

[51] Int. Cl.[5] ..... A63F 9/08

[52] U.S. Cl. ..... 273/153 S; 273/155; 446/487

[58] Field of Search ..... 273/153 R, 153 S, 155, 273/159; 446/119, 487, 489, 490

[56] References Cited

U.S. PATENT DOCUMENTS 4,452,454 6/1984 Greene ..... 273/153 S 4,919,427 4/1990 Keidar et al. ..... 273/155

*Primary Examiner*—William H. Grieb

*Assistant Examiner*—William A. Pierce

*Attorney, Agent, or Firm*—John F. Ohlandt

[57] ABSTRACT

A self-contained loop puzzle has a plurality of closely spaced casements, selected casements being rotatable around their longitudinal axes of symmetry. Selected casements contain an indicia bearing tile and a second indicia bearing tile in spaced relationship such that the plurality of casements presents a series of tiles in a given order, and at least two spaced tracks are defined by the closely spaced casements in the loop. The tiles are slidably in the respective tracks, whereby selective, partial rotation of casements and the sliding movement of tiles along the loop produces a reverse order for the series of tiles.

7 Claims, 4 Drawing Sheets

PUZZLE HAVING TILES TRANSFERABLE BETWEEN CASEMENTS CONNECTED IN A LOOP

BACKGROUND IN THE INVENTION

The Rubik's cube, which may be defined as a three-dimensional twist puzzle, and the Lloyd square, a two-dimensional slide puzzle involving the movement of tiles, have become staples in the hand-held or hand-controlled puzzle field.

As is well known, the Rubik's cube puzzle or game involves side walls forming the Rubik's cube having different colors and the object of the game is to align all the common colors on one side of the large cube by manipulating groups of cubes about various axes.

Another popular game wherein square blocks are manipulated about a board is disclosed in U. S. Pat. No. 785,665, granted on Mar. 21, 1905. Also, in U. S. Pat. No. 3,081,089 there is disclosed a manipulatable toy in the form of a mechanical puzzle which includes a plurality of varied color parts which are movable relative to each other to form various patterns. Other U. S. patents which may be referred to for their disclosures of manipulatable puzzles or games are U. S. Pat. Nos. 4,452,454 and 4,949,969.

Of the above-noted puzzles, the Rubik's cube, has been ver popular in recent years, and the Lloyd square has been popluar for a more extended period. However, the novelty of any such games or puzzles has a limited lifetime.

Accordingly, it is a fundamental object of the present invention to provide a new puzzle that will stimulate and challenge the puzzle solver.

SUMMARY OF THE INVENTION

A manipulative puzzle constructed according to the present invention is in a loop configuration (sometimes referred to as "the noose") whose various elements may be selectively rotated around the loop axis or moved around the loop in a sliding motion. Additionally, the whole loop may be twisted in certain embodiments. Accordingly, the noose is in geometric forms of two types: (1) the intriguing one-sided Moebius loop or strip and (2) the toruslike loop which, as will be made clear, has two or more separate surfaces, unlike the Moebius strip which has only one.

The puzzle of the present invention, like its predecessors, is deceptive in that it is simple to understand but almost impossible to do. More interestingly, the problems engage the solver of the puzzle immediately, leading him quickly into a maze from which he can extricate himself only by careful reasoning. In one particular embodiment of the puzzle, indicia of various kinds are placed on the tiles of the puzzle and a particular order is selected for a series of tiles in a given direction along the loop. The challenge is, in one example, to reverse the order of tiles, starting from a given reference point and in the given direction. The tiles are disposed in separate rows or tracks defined by the closely spaced casements forming the loop.

In one specific example, or as one feature of the present invention, a rigid shaft or carrier is included in the loop configuration and each of the spaced casements which are placed in the loop includes a bore surrounding the rigid shaft or carrier for enabling a friction fit thereon of the casements so that they may be easily rotated. If desired, certain casements can each be made fixed or non-rotatable about its longitudinal axis of symmetry.

Briefly stated, the main feature of the puzzle invention comprises a plurality of closely spaced casements forming a loop, selected casements each being rotatable around its longitudinal axis of symmetry; at least two spaced tracks defined by said closely spaced casements forming said loop; selected casements each containing a first indicia-bearing tile and a second indicia-bearing tile in spaced relationship such that the plurality of casements presents a series of tiles in a given order; said tiles being slidable in said respective tracks along said loop whereby selective rotation of casements, as well as the sliding movement of tiles, produces another order, different from the given order, for the series of tiles.

It will be appreciated as the description proceeds that each of the particular loops or "nooses" of the puzzle of the present invention can be made in the several forms or embodiments already briefly described, whose difficulty of solution ranges from easy to almost impossible.

Furthermore, it will be appreciated that the tile puzzles of the present invention in the form of the loops are very inexpensive to manufacture.

BRIEF DESCRIPTION OF THE DRAWING

Other and further objects, advantages and features of the present invention will be understood by reference to the following specification in conjunction with the annexed drawing, wherein like parts have been given like numbers.

DESCRIPTION OF PREFERRED EMBODIMENTS

Figure 1:
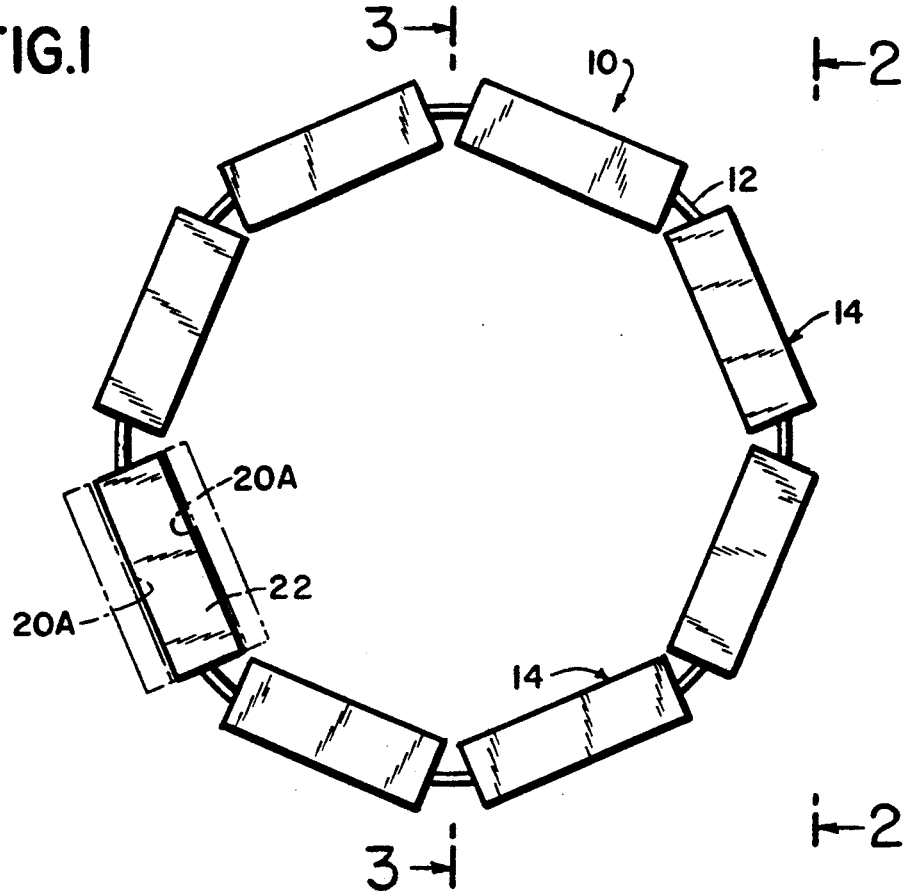
FIG. 1 is a side elevational view of one embodiment of the puzzle in accordance with the present invention.
Figure 2:
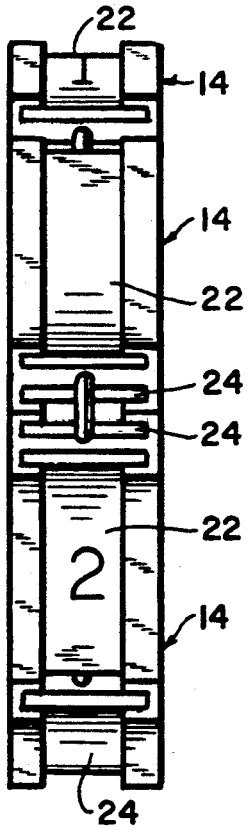
FIG. 2 is an end view taken on the line 2—2 see in FIG. 1.
Figure 3:
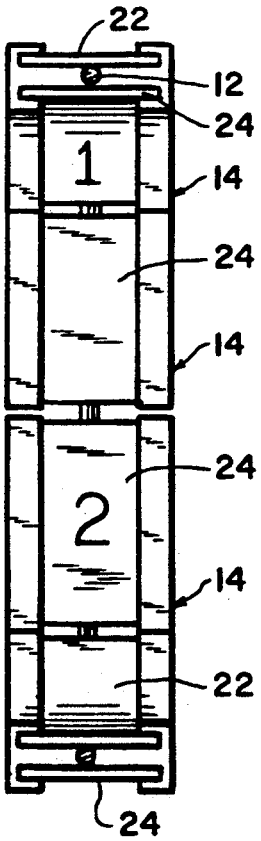
FIG. 3 is a sectional view taken on the line 3—3 of FIG. 1.

Referring now to the figures of the drawing, it will be recalled that there are basically two forms of the puzzle: the Moebius "noose" or loop and the torus-like "noose". The noose may vary in length, i.e., number of tiles, and in the geometry of the tile casements, that is, two-sided, three-sided, etc.

Figure 4:
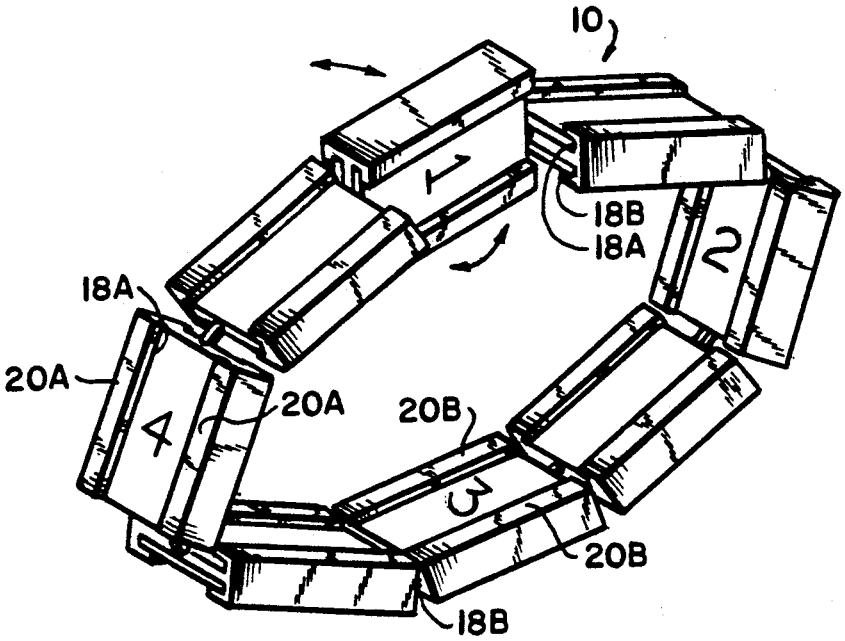
FIG. 4 is a perspective view for the purpose of illustrating the complete rotation of one of the casements on its axis of symmetry.

In FIG. 1 there is depicted one example of the torus-like loop 10 which can include as part of the loop, a carrier 12 on which a plurality of segments or casements 14 are strung or mounted, each casement 14 preferably being rotatable about its longitudinal axis of symmetry (see FIG. 4 in which the double-headed arrows indicate rotation or spinning). For this purpose, the carrier 12 is preferably semi-rigid plastic or rubber, a friction fit being achieved by providing a suitably dimensioned bore 16 in each of the casements. As noted previously, if it is desired that certain casements, such as those selected to be devoid of tiles, be non-rotatable, suitable preclusion means can be adopted, such as reducing the diameter of the bore of those casements to make an extremely tight fit with the carrier 12.

Figure 5:
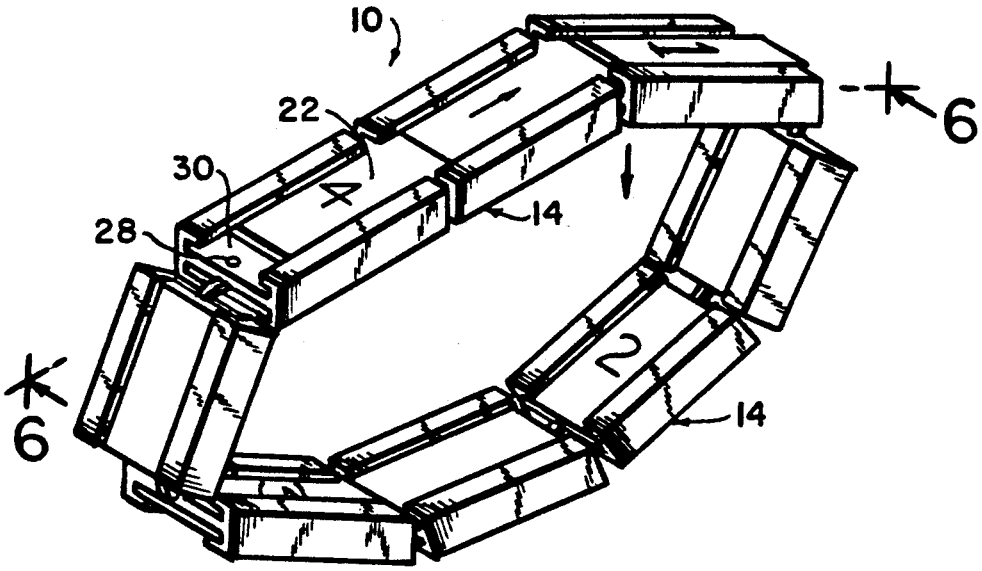
FIG. 5 is another perspective view of the loop puzzle and particularly illustrating an adjustment in position of the flexible casements so that a tile can be readily moved from one casement to the next in a common plane.

It will be seen in FIG. 5 that, given the proportions of the embodiment illustrated, it is useful that the casements 14 be somewhat flexible so that they be capable of being bent into a single plane as shown in FIG. 5, whereby a tile may be readily moved from one casement to another.

Figures 6, 7, 8, 9:
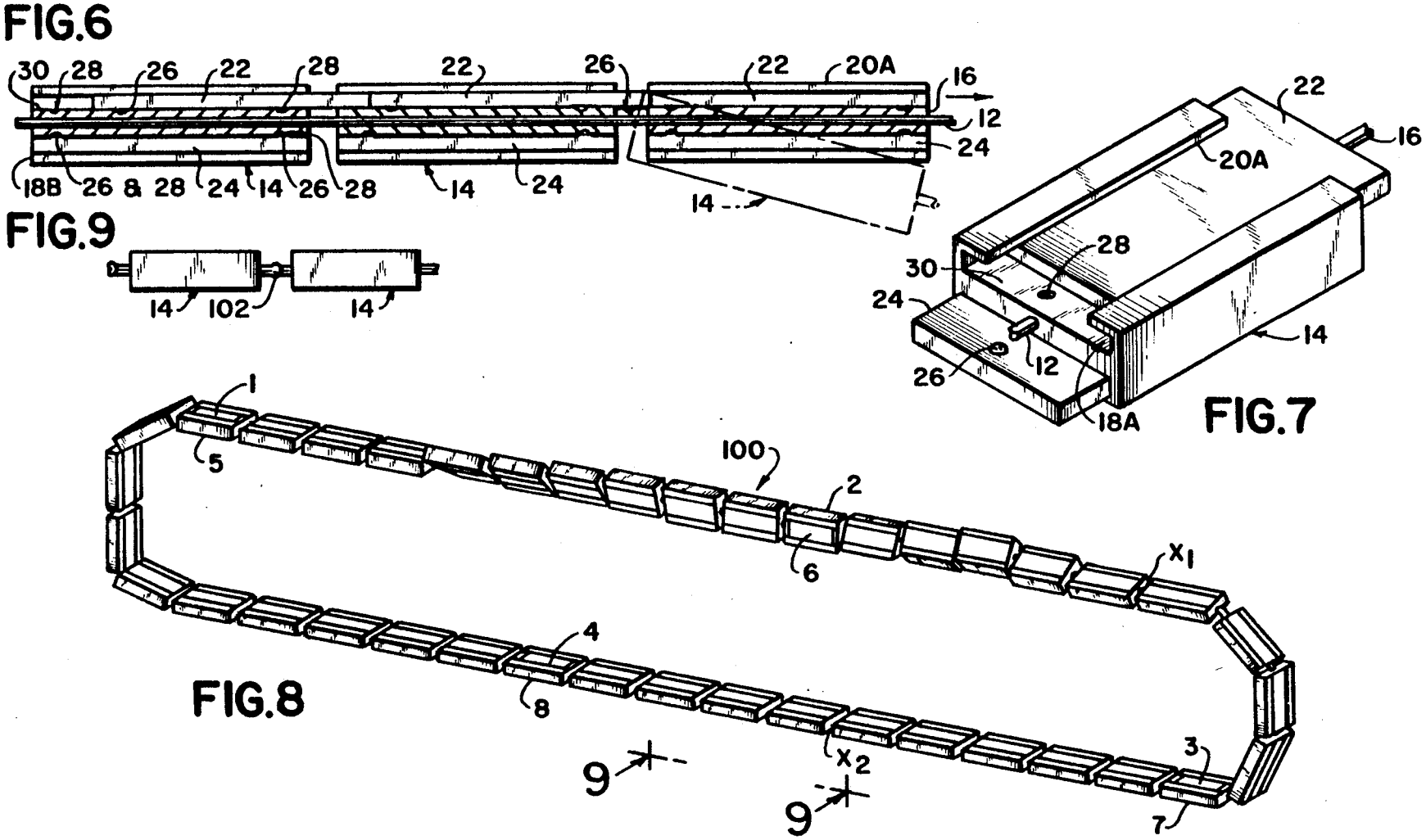
FIG. 6 is a cross-sectional view taken on the line 6—6 of FIG. 5 and particularly illustrating the movement of tiles in the other row of tiles along tracks defined in the casements.
FIG. 7 is a perspective view of one of the individual casements and particularly illustrating the movement of a tile in the casement tracks along the loop or noose embodiment for the tile puzzle.
FIG. 8 is a perspective view of a Moebius loop embodiment featuring the casements shown in FIG. 7.
FIG. 9 is an elevational view taken on the line 9—9 in FIG. 8, particularly illustrating the connection of several casements in the Moebius loop.
Figure 10:
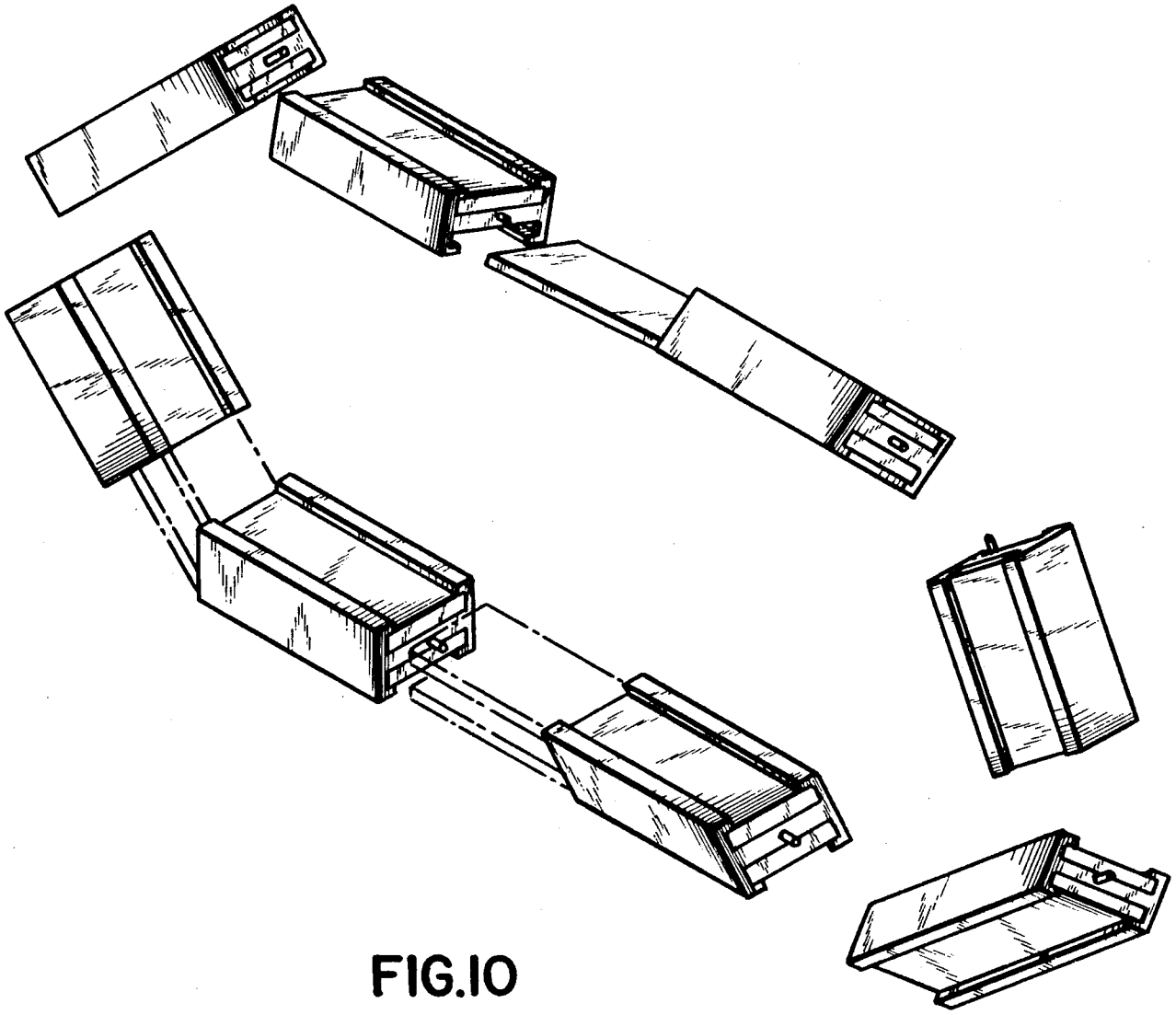
FIG. 10 is a fragmentary exploded view of the loop is FIG. 8 for the purpose of illustrating the sliding of tiles in several rows when the loop is in its "normal" state.

Referring now to FIGS. 6 and 7, the details of the construction of exemplary casements are shown. Thus it will be seen that individual tracks 18A and 18B are formed on opposite sides respectively of the casements 14, each track being formed by a pair of opposite edges 20A and 20B on the respective sides of the casements. Taken all together, the individual tracks define independent endless tracks in which a series of tiles are disposed in inner and outer rows. A tile 22 is shown in the upper part of casement 14 in FIG. 6, whereas tile 24 is shown in the lower part of the casement. Each of the tiles includes spaced bumps 26 at either end thereof, and corresponding pairs of dimples or depressions 28 are formed in the respective abutting surfaces of the casements for receiving the pairs of bumps such that a detent means is constituted to prevent undesired movement of the tiles.

Referring now particularly of FIGS. 4 and 5, a solution will be given for the simple case of reversing the order or sequence of the top and bottom tiles, that is, changing the clockwise order 1, 2, 3, 4 to 4, 3, 2, 1 in each of the inner and outer rows of the assembly seen in those figures.

The first step to be carried out is to slide the tiles of the inner and outer rows such that each of the tiles advances one step (one number tile position) to the right so that the sequence of each of the rows starting at the previous reference point becomes:

4 1 2 3 (outer)
4 1 2 3 (inner)

The next step is to slide the inner row of tiles two steps clockwise. Thus, the result for each of the rows now is:

4 1 2 3 (outer)
2 3 4 1 (inner)

Now each of the casements 14 containing the tiles 3 and 1 and 1 and 3, that is, the casement having 3 in its outer row with 1 at its inner row in the same casement and 1 in the outer row and 3 in the inner row in another casement, is spun or rotated about its axis such that the result for the two rows is as follows:

4 3 2 1 which is what was to be accomplished.

It will thus be seen that in four simple steps, the objective of completely reversing the order of each of the rows has been achieved.

Another preferred embodiment, sometimes referred to as a Moebius loop or noose, constitutes an even more intriguing puzzle than the first preferred embodiment. Referring now to FIG. 8, a similar loop 100 to the loop 10 of FIG. 1 is depicted, in which the number tiles, selected to be eight in number, are included as part of the loop. Nine casements which are devoid of tiles separate, for example, each of the consecutive number tiles: thus, for example, nine casements 14 are seen to separate the number tiles 7 and 8.

In order to define the so-called Moebius loop, a single twist can be selectively placed in the loop 100 at a variety of convenient points, the twist being placed and removed by means of the connecting means 102 (FIG. 9) disposed on the carrier 12 between successive casements 14.

It will be understood that for the sake of ease of illustration and explanation of the Moebius loop puzzle of FIG. 8, those casements between numbered tile casements are shown devoid of tiles. However, in principle, with a different kind of construction it would be appropriate to include blank tiles in the arrangement, as in FIG. 1. Alternately, the loop 100 could comprise only casements having numbered tiles.

In any event, the material of the puzzle is selected such that only one twist (180 degrees) can be produced for defining a Moebius loop; any additional twists are undesirable because they would produce no useful effects. As before, the object of the game is to completely reverse the order of the tiles in the chosen direction, that is, in the clockwise direction as seen in FIG. 8. However, the order reversal here involves eight tiles in a Moebius loop.

The first step in the solution of the problem of completely reversing the order of numbered tiles is, as seen in FIG. 8, to cause disconnection of casements between the tiles numbered 1 and 2 in the loop 100 of FIG. 8. This break is indicated by the $X_1$ symbol at the top right of the figure, this being accomplished by hand gripping the casements on opposite sides of the break point and causing them to separate due to the connecting means 102 at that point.

It will be borne in mind that instead of separate or independent rows, only a single row or single surface is present in the Moebius loop, or, more precisely, the Moebius state for the given loop 100. The untwisted state shall be called the normal state for the Moebius embodiment of FIG. 8.

Now, given the two independent rows, that is, an outer row which includes the series of tiles 7, 8, 1, 2 in clockwise sequence, and an inner row 3, 4, 5, 6 in clockwise sequence, what is done is the two tiles 5, 6 are slid around the loop, thereby pushing adjacent tiles. Thus, they are slid from the positions seen in FIG. 8 to positions two tiles removed in the clockwise direction. Thus, the newer alignment is as follows:

7, 8, 1, 2 (outer row)
5, 6, 3, 4 (inner row)

Accordingly, the tiles 7 and 5 are now contained on opposite sides of a given casement; 8 and 6 on opposite sides in the next adjacent numbered tile casement, and so forth The next step is reversion to the Moebius state by using the disconnect means 102 located between tiles 7 and 8 (as well as between 5 and 6, as indicated by break point X2). Now the procedure is in the reverse direction in the sense that one goes from the normal state back to the Moebius state, this being accomplished by disconnecting the casements, twisting the loop 100, and reconnecting the casements. The tiles in the Moebius loop are now in the following sequence: 8, 1, 2, 7, 6, 3, 4, 5.

The next step is essentially a repeat of the first step except that now the break and the twist is performed between tiles 3 and 4 on the already existing Moebius sequence, indicated immediately above, so that the outer and inner rows appear as follows:

2 7 6 3 (outer)
4 5 8 1 (inner)

Now the same second step as before, that is, the movement of two tiles two steps clockwise is performed to yield the following sequence in the two independent outer and inner rows:

2 7 6 3 (outer row)
8 1 4 5 (inner row)

This again is another normal state.

Another break is made to revert to the Moebius state loop such that the new Moebius sequence is 8, 7, 6, 3, 2, 1, 4, 5. This, in turn, is disconnected; that is, the Moebius already created is changed to normal by a break between tiles 6 and 3 to yield the two independent inner and outer rows as follows:

5, 8, 7, 6 (outer)
3, 2, 1, 4 (inner)

The next step is another sliding step exactly like the previous two sliding steps, that is, the tiles 1 and 4 are moved to the locations formerly occupied by tiles 3 and 2 respectively. Accordingly, the sequences of the two rows are as follows:

5 8 7 6 (outer)
1 4 3 2 (inner)

Now the final step is performed whereby the change is made from the normal state to the Moebius state and it will be seen that the Moebius loop 100 has the tiles in completely reverse order from the original; i.e.: 8, 7, 6, 5, 4, 3, 2, 1.

It is well to note that any other sequence starting with a different initial break from the Moebius state to the normal state (other than 2, 3 or 6, 7) will not work.

It will be apparent that the several embodiments of the loop puzzle presented herein do not exhaust the possibilities. For example, the Moebius loop could be expanded to sixteen tiles to provide a greater challenge to the solver. The torus loop version or embodiment could involve a different number of sides, such as three, five, seven, etc.

While there have been shown and described what are considered at present to be the preferred embodiments of the present invention, it will be appreciated by those skilled in the art that modifications of such embodiments may be made. It is therefore desired that the invention not be limited to these embodiments, and it is intended to cover in the appended claims all such modifications as fall within the true spirit and scope of the invention.

What is claimed is:

1. A puzzle comprising:

(a) a plurality of closely spaced casements and means for joining the casements to form a closed loop; said casements each having a longitudinal axis of symmetry; each of said casements being rotatable around its axis and each including pairs of opposite edges for defining respective portions of at least two spaced tracks;

(b) selected casements each retaining a first indicia-bearing tile and a second indicia-bearing tile in spaced relationship in the respective track portions such that the plurality of casements in said closed loop presents in the defined tracks a respective series of tiles in a given order;

(c) said tiles being loosely held in said tracks so as to be slidable in said respective tracks around said closed loop, whereby selective sliding movement and rotation of casements produces another order, different from the given order, for each of said series of tiles.

2. A puzzle as defined in claim 1, in which said casements include radially and longitudinally directed L-shaped edges for retaining said indicia-bearing tiles.

3. A puzzle as defined in claim 2, further comprising independent, endless outer and inner rows, said respective series of tiles being disposed in said rows.

4. A puzzle as defined in claim 1, in which a carrier is included in said loop; and in which each casement includes a bore surrounding said carrier for enabling rotation of the casement; a detent means comprising a bump in a surface of a tile; and, means for receiving said bump, said means including a corresponding depression in the surface of a casement abutting said tile surface.

5. A puzzle comprising:

(a) a plurality of closely spaced casements and means for joining the casements to form a loop, said loop being a Moebius or 180 degree twisted loop, each of said casements including pairs of opposite edges for defining at least respective portions of two spaced tracks;

(b) at least two spaced tracks defined by said closely spaced casements forming said loop, said two spaced tracks extending in a single row around said loop;

(c) selected casements each containing a first indicia-bearing tile and a second indicia-bearing tile in spaced relationship in the respective track portions such that the plurality of casements presents in the defined tracks respective series of tiles in a given order;

(d) said tiles being loosely held in said tracks so as to be slidable in the resepctive tracks when said Moebius loop is in its normal state, and said loop being twistable 180 degrees, such that another order, different from the given order, is achieved for the series of tiles.

6. A puzzle as defined in claim 5, further comprising means for connecting and disconnecting the Moebius loop so as to place it in the Moebius state and to return it to the normal state.

7. A puzzle as defined in claim 6, in which a pair of radially and longitudinally directed opposite edges on the sides of each of said casements define said tracks in which said tiles are slidable.

* * * * *